US011029625B2

(12) United States Patent
Araki et al.

(10) Patent No.: US 11,029,625 B2
(45) Date of Patent: Jun. 8, 2021

(54) IMAGE FORMING APPARATUS

(71) Applicant: FUJIFILM Business Innovation Corp., Tokyo (JP)

(72) Inventors: Kotaro Araki, Kanagawa (JP); Masaaki Yamaura, Kanagawa (JP); Yoshinori Takahashi, Kanagawa (JP); Yoshiyuki Tominaga, Kanagawa (JP); Ayumi Noguchi, Kanagawa (JP); Takeshi Yasuda, Kanagawa (JP); Masahiro Katahira, Kanagawa (JP)

(73) Assignee: FUJIFILM BUSINESS INNOVATION CORP., Tokyo (JP)

( * ) Notice: Subject to any disclaimer, the term of this patent is extended or adjusted under 35 U.S.C. 154(b) by 0 days.

(21) Appl. No.: 16/872,467

(22) Filed: May 12, 2020

(65) Prior Publication Data

US 2021/0072694 A1 Mar. 11, 2021

(30) Foreign Application Priority Data

Sep. 5, 2019 (JP) ..... JP2019-162161

(51) Int. Cl.
*G03G 15/16* (2006.01)
*G03G 21/00* (2006.01)

(52) U.S. Cl.
CPC ..... *G03G 15/161* (2013.01); *G03G 21/0035* (2013.01); *G03G 2221/0005* (2013.01)

(58) Field of Classification Search
CPC ..... G03G 15/161; G03G 21/0005; G03G 21/007; G03G 21/0011; G03G 21/0035; G03G 21/0076; G03G 2215/1647; G03G 2215/1661; G03G 2215/00717–00767; G03G 2221/001; G03G 2221/0005; G03G 2221/0026; G03G 2221/1627
See application file for complete search history.

(56) References Cited

U.S. PATENT DOCUMENTS

2006/0083526 A1* 4/2006 Shida ..... G03G 15/168 399/45

FOREIGN PATENT DOCUMENTS

JP 2009-186883 A 8/2009

* cited by examiner

*Primary Examiner* — Thomas S Giampaolo, II
(74) *Attorney, Agent, or Firm* — Sughrue Mion, PLLC

(57) ABSTRACT

An image forming apparatus includes: an image carrier configured to carry an image; a transfer unit configured to transfer the image to a medium; and a cleaner configured to remove deposits on a surface of the image carrier after passing through a position of the transfer unit, in which when a type of a medium to be used is a first medium, the cleaner improves an ability to remove the deposits from the image carrier as compared with a case where the medium to be used is a second medium having a lower transfer sensitivity than the first medium.

15 Claims, 9 Drawing Sheets

IMAGE FORMING APPARATUS

CROSS-REFERENCE TO RELATED APPLICATIONS

This application is based on and claims priority under 35 USC 119 from Japanese Patent Application No. 2019-162161 filed Sep. 5, 2019.

BACKGROUND

1. Technical Field

The present disclosure relates to an image forming apparatus.

2. Related Art

In an image forming apparatus such as a copier, a printer, and a facsimile machine, a technique described in JP-A-2009-186883 (see claim 7, paragraphs [0027] to [0043] and FIGS. 2 and 4) below is known as a cleaner that cleans an image carrier such as a photoreceptor or an intermediate transfer body.

JP-A-2009-186883 discloses that a cleaning auxiliary brush (81) rotated by a driving unit has two types of bristle members (812, 813) having different charging characteristics, a toner removing bristle member (812) having long bristles is in contact with the intermediate transfer body (6), and a charging/discharging bristle member (813) having short bristles is disposed in non-contact with the intermediate transfer body (6). In JP-A-2009-186883, a developer adhered to the intermediate transfer body (6) is mechanically scraped and removed with the toner removing bristle member (812), and the developer is removed by electrostatically attracting the developer with the charging/discharging bristle member (813).

SUMMARY

Aspects of non-limiting embodiments of the present disclosure relate to securing transferability to a medium having a high transfer sensitivity as compared with a case where the same cleaning is performed when a medium has a high transfer sensitivity and when a medium has a low transfer sensitivity.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an image forming apparatus including: an image carrier configured to carry an image; a transfer unit configured to transfer the image to a medium; and a cleaner configured to remove deposits on a surface of the image carrier after passing through a position of the transfer unit, in which when a type of a medium to be used is a first medium, the cleaner improves an ability to remove the deposits from the image carrier as compared with a case where the medium to be used is a second medium having a lower transfer sensitivity than the first medium.

BRIEF DESCRIPTION OF THE DRAWINGS

Exemplary embodiment(s) of the present disclosure will be described in detail based on the following figures, wherein:

FIG. 3A is a diagram illustrating a state in which a rotary brush has moved to a reference position, and FIG. 3B is a diagram illustrating a state in which the rotary brush has moved to a pressing position;

FIG. 5A is a diagram illustrating an example of low-sensitivity paper, FIG. 5B is a diagram illustrating an example of embossed paper, and FIG. 5C is a diagram illustrating an example of Japanese paper;

FIG. 6A is a diagram illustrating a normal position, and FIG. 6B is a diagram illustrating a biting position;

FIG. 7A is a diagram illustrating a case where high sensitivity paper is used, and FIG. 7B is a diagram illustrating a case where low-sensitivity paper is used;

DETAILED DESCRIPTION

Figure 1:
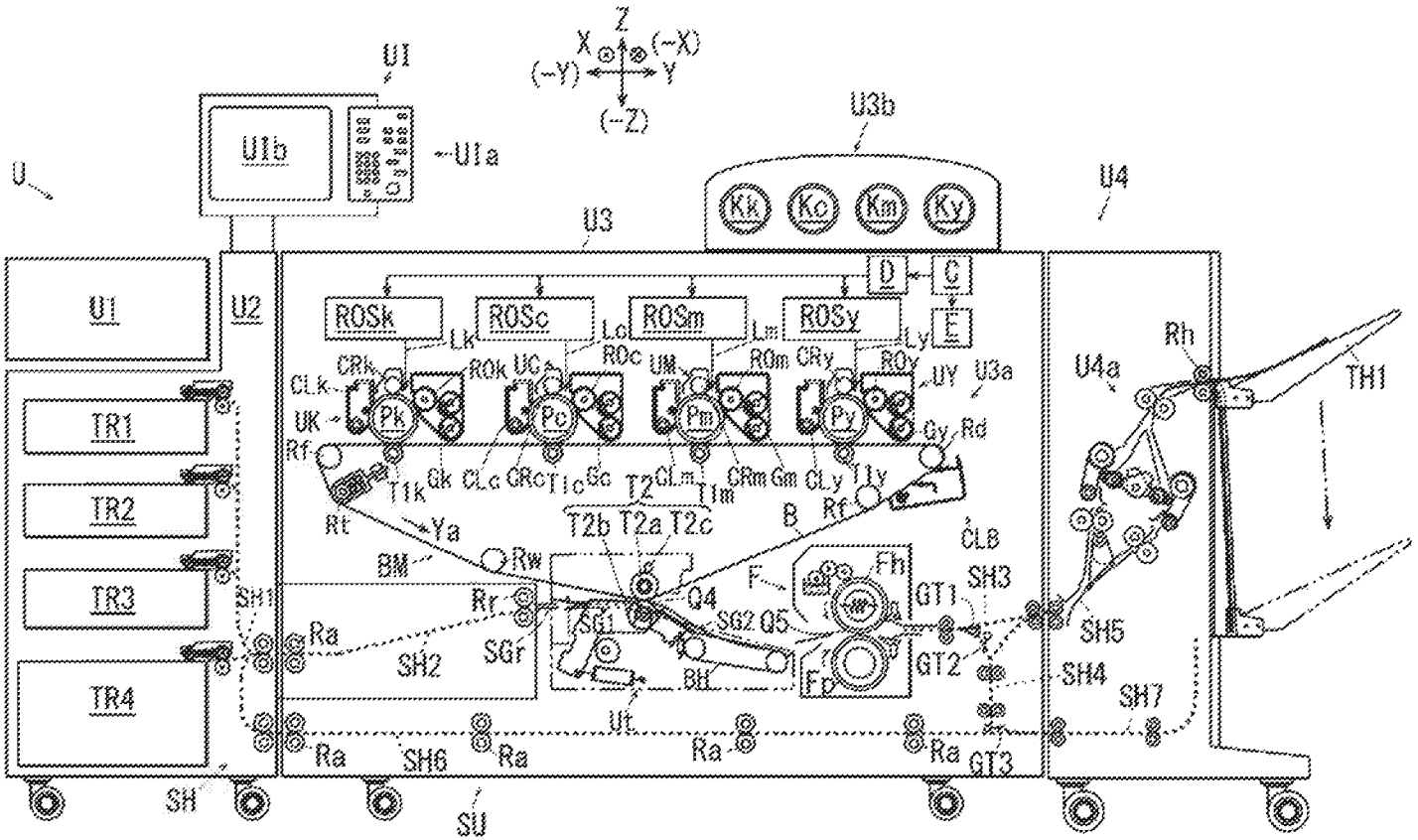
FIG. 1 is a diagram illustrating an overall image forming apparatus according to Example 1.

Next, specific examples of exemplary embodiments of the present disclosure (hereinafter, referred to as Examples) will be described with reference to the drawings, but the present disclosure is not limited to the following Examples.

In order to facilitate the understanding of the following description, in the drawings, the longitudinal direction is referred to as an X-axis direction, the horizontal (left and right) direction is referred to as a Y-axis direction, the vertical direction is referred to as a Z-axis direction. The directions or sides indicated by arrows "X", "−X", "Y", "−Y", "Z", and "−Z" are front, rear, right, left, upper, lower, or front side, rear side, right side, left side, upper side, and lower side, respectively.

Further, in the drawings, the symbols with "•" in "○" indicate arrows pointing from the back of the paper to the front, and the symbols with "x" in "○" indicate arrows pointing from the front of the paper to the back.

In the following description using drawings, members other than members necessary for the description are omitted as appropriate for easy understanding.

Example 1

FIG. 1 is a diagram illustrating an overall image forming apparatus according to Example 1.

Figure 2:
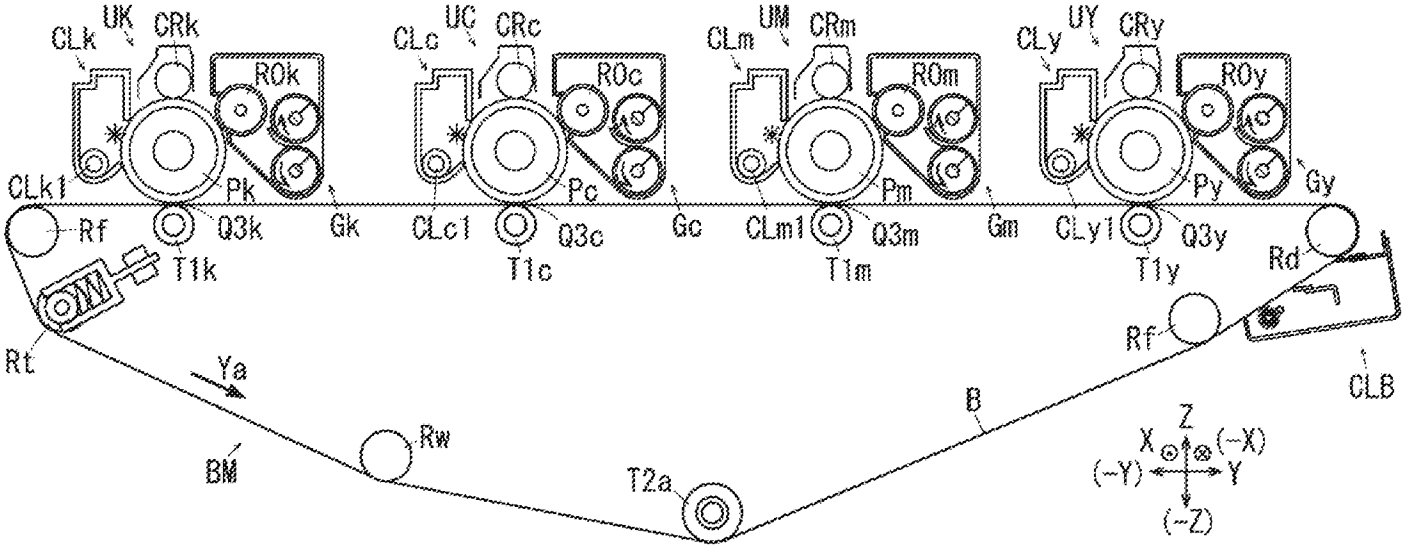
FIG. 2 is an enlarged explanatory view of a visible image forming apparatus according to Example 1.

FIG. 2 is an enlarged explanatory view of a visible image forming apparatus according to Example 1.

In FIG. 1, a copier U as an example of an image forming apparatus includes a user interface UI as an example of an operation unit, a scanner unit U1 as an example of an image reading device, a feeder unit U2 as an example of a medium supply device, an image forming unit U3 an example of an image recording device, and a medium processing device U4.

(Description of User Interface UI)

The user interface UI has an input button UIa used to start copying and set the number of copies. Further, the user interface UI has a display unit UIb on which the content input by the input button UIa and the state of the copier U are displayed.

(Description of Feeder Unit U2)

In FIG. 1, the feeder unit U2 has plural sheet feeding trays TR1, TR2, TR3, and TR4 as an example of a medium accommodating container. Further, the feeder unit U2 has a medium supply path SH1 that takes out recording sheet S as an example of an image recording medium stored in each of the sheet feeding trays TR1 to TR4 and transports the recording sheet S to the image forming unit U3.

(Description of Image Forming Unit U3 and Medium Processing Device U4)

In FIG. 1, the image forming unit U3 has an image recording unit U3*a* that records an image on the recording sheet S transported from the feeder unit U2 based on a document image read by the scanner unit U1.

In FIGS. 1 and 2, a drive circuit D of a latent image forming apparatus of the image forming unit U3 outputs a drive signal corresponding to image information input from the scanner unit U1 to the latent image forming apparatuses ROSy, ROSm, ROSc, and ROSk of respective colors Y to K at a preset time based on the image information input from the scanner unit U1. Below the latent image forming apparatuses ROSy to ROSk, photoreceptor drums Py, Pm, Pc, and Pk are respectively arranged as an example of an image carrier.

The surfaces of the rotating photoreceptor drums Py, Pm, Pc, and Pk are uniformly charged by charging rolls CRy, CRm, CRc, and CRk as an example of a charger. On the surfaces of the photoreceptor drums Py to Pk whose surfaces are charged, an electrostatic latent image is formed by laser beams Ly, Lm, Lc, and Lk as an example of latent image writing light output by the latent image forming apparatuses ROSy, ROSm, ROSc, and ROSk. The electrostatic latent images on the surfaces of the photoreceptor drums Py, Pm, Pc, and Pk are developed into toner images as examples of visible images of yellow (Y), magenta (M), cyan (C), and black (K) by developing devices Gy, Gm, Gc, and Gk.

In the developing devices Gy to Gk, the developer consumed by the development is supplied from toner cartridges Ky, Km, Kc, and Kk as an example of a developer accommodating container. The toner cartridges Ky, Km, Kc, and Kk are detachably mounted on a developer supply device U3*b*.

The toner images on the surfaces of the photoreceptor drums Py, Pm, Pc, and Pk are sequentially transferred in primary transfer regions Q3*y*, Q3*m*, Q3*c*, and Q3*k* on an intermediate transfer belt B as an example of an intermediate transfer body by primary transfer rolls T1*y*, T1*m*, T1*c*, and T1*k* as examples of a primary transfer device, and a color toner image as an example of a multicolor visible image is formed on the intermediate transfer belt B. The color toner image formed on the intermediate transfer belt B is transported to a secondary transfer region Q4.

When only the K color image information is used, only the photoreceptor drum Pk and the developing device Gk of the K color are used, and only the K color toner image is formed.

With respect to the photoreceptor drums Py, Pm, Pc, and Pk after a primary transfer, drum cleaners CLy, CLm, CLc, and CLk as an example of a cleaner for the image carrier remove residues such as residual developer and paper dust attached to the surface.

In Example 1, the photoreceptor drum Pk, the charging roll CRk, and the drum cleaner CLk are integrated as a K-color photoreceptor unit UK as an example of an image carrier unit. Similarly, the photoreceptor units UY, UM, and UC are constituted by the photoreceptor drums Py, Pm, and Pc, the charging rolls CRy, CRm, and CRc, and the drum cleaners CLy, CLm, and CLc for the other colors Y, M, and C.

Further, a K-color visible image forming apparatus UK+Gk is constituted by the K-color photoreceptor unit UK and the developing device Gk having a developing roll R0*k* as an example of a developer carrier. Similarly, the Y-, M-, and C-color visible image forming apparatuses UY+Gy, UM+Gm, and UC+Gc are respectively constituted by the photoreceptor units UY, UM, and UC of Y, M, and C colors and the developing devices Gy, Gm, and Gc that have the developing rolls R0*y*, R0*m*, and R0*c*.

A belt module BM as an example of an intermediate transfer device is arranged below the photoreceptor drums Py to Pk. The belt module BM includes an intermediate transfer belt B as an example of an image carrier, a driving roll Rd as an example of a driving member of the intermediate transfer body, a tension roll Rt as an example of a tension applying member, a walking roll Rw an example of a meandering preventing member, plural idler rolls Rf as examples of a driven member, a backup roll T2*a* as an example of an opposing member, and the primary transfer rolls T1*y*, T1*m*, T1*c*, and T1*k*. The intermediate transfer belt B is rotatably supported in the direction of an arrow Ya.

A secondary transfer unit Ut is arranged below the backup roll T2*a*. The secondary transfer unit Ut has a secondary transfer roll T2*b* as an example of a secondary transfer member. A secondary transfer region Q4 is formed by a region where the secondary transfer roll T2*b* contacts the intermediate transfer belt B. Further, the backup roll T2*a* as an example of an opposing member is opposed to the secondary transfer roll T2*b* while the intermediate transfer belt B is interposed therebetween. A contact roll T2*c* as an example of a power supply member is in contact with the backup roll T2*a*. A secondary transfer voltage having the same polarity as the charged polarity of the toner is applied to the contact roll T2*c*.

The backup roll T2*a*, the secondary transfer roll T2*b*, and the contact roll T2*c* constitute a secondary transfer device T2 as an example of a transfer unit.

A medium transport path SH2 is arranged below the belt module BM. The recording sheet S fed from the medium supply path SH1 of the feeder unit U2 is transported by a transport roll Ra as an example of a medium transport member to a registration roll Rr as an example of a transport timing adjustment member. The registration roll Rr transports the recording sheet S to the downstream side at the time when the toner image formed on the intermediate transfer belt B is transported to the secondary transfer region Q4. The recording sheet S sent out by the registration roll Rr is guided by a sheet guide SGr on the registration side and a sheet guide SG1 before transfer, and is transported to the secondary transfer region Q4.

The toner image on the intermediate transfer belt B is transferred to the recording sheet S by the secondary transfer device T2 when passing through the secondary transfer region Q4. In the case of a color toner image, the primary-transferred toner images superimposed on the surface of the intermediate transfer belt B are collectively secondarily transferred to the recording sheet S.

The transfer devices T1*y* to T1*k*+T2+B of Example 1 are constituted by the primary transfer rolls T1*y* to T1*k*, the secondary transfer device T2, and the intermediate transfer belt B.

The intermediate transfer belt B after the secondary transfer is cleaned by a belt cleaner CLB as an example of an intermediate transfer body cleaning device which is disposed downstream of the secondary transfer region Q4. The belt cleaner CLB as an example of a cleaner removes, from the intermediate transfer belt B, deposits such as developers, paper dust, and discharge products remaining on the surface of the intermediate transfer belt B after passing through the secondary transfer region Q4.

The recording sheet S on which the toner image has been transferred is guided by a sheet guide SG2 after the transfer, and sent to a medium transport belt BH as an example of a transport member. The medium transport belt BH transports the recording sheet S to a fixing device F.

The fixing device F includes a heating roll Fh as an example of a heating member and a pressure roll Fp as an example of a pressure member. The recording sheet S is transported to a fixing region Q5 that is a region where the heating roll Fh and the pressure roll Fp are in contact. When passing through the fixing region Q5, the toner image on the recording sheet S is heated and pressed by the fixing device F and then fixed.

The visible image forming apparatuses UY+Gy to UK+Gk, the transfer devices T1*y* to T1*k*+T2+B, and the fixing device F constitute an image recording unit U3*a* as an example of an image forming unit of Example 1.

A switching gate GT1 as an example of a switching member is provided downstream of the fixing device F. The switching gate GT1 selectively switches the recording sheet S that has passed through the fixing region Q5 to either a discharge path SH3 or a reverse path SH4 of the medium processing device U4. The recording sheet S transported to the discharge path SH3 is transported to a sheet transport path SH5 of the medium processing device U4. A curl correction member U4*a* as an example of a warp correction member is disposed in the sheet transport path SH5. The curl correction member U4*a* corrects the warpage of the loaded recording sheet S, so-called curl. The curl-corrected recording sheet S is discharged by a discharge roll Rh as an example of a medium discharge member onto a discharge tray TH1 as an example of a medium discharge unit while the image fixing surface of the sheet faces upward.

The recording sheet S transported by the switching gate GT1 to the reverse path SH4 side of the image forming unit U3 is transported to the reverse path SH4 of the image forming unit U3 through a second gate GT2 as an example of a switching member.

At this time, when the image fixing surface of the recording sheet S is discharged downward, a transporting direction of the recording sheet S is reversed after the trailing end in the transport direction of the recording sheet S passes through the second gate GT2. Here, the second gate GT2 of Example 1 is formed of a thin film-like elastic member. Therefore, the second gate GT2 once passes the recording sheet S transported to the reverse path SH4 as it is, and when the passing recording sheet S is reversed, so-called switched back, the passing recording sheet S is guided to the transport paths SH3 and SH5. The recording sheet S that has been switched back passes through the curl correction member U4*a* and is discharged to the discharge tray TH1 while the image fixing surface faces down.

A circulation path SH6 is connected to the reverse path SH4 of the image forming unit U3, and a third gate GT3 as an example of a switching member is disposed at the connection. Further, the downstream end of the reverse path SH4 is connected to the reverse path SH7 of the medium processing device U4.

The recording sheet S transported to the reverse path SH4 through the switching gate GT1 is transported to the reverse path SH7 of the medium processing device U4 by the third gate GT3. The third gate GT3 of Example 1 is made of a thin film-like elastic member, like the second gate GT2. Therefore, the third gate GT3 once passes the recording sheet S transported on the reverse path SH4, and guides the recording sheet S to the circulation path SH6 when the passing recording sheet S is switched back.

The recording sheet S transported to the circulation path SH6 is re-transmitted to the secondary transfer region Q4 through the medium transport path SH2, and a second surface is printed.

The sheet transport path SH is constituted by the elements indicated by the symbols SH1 to SH7. Further, the elements indicated by the symbols "SH", "Ra", "Rr", "Rh", "SGr", "SG1", "SG2", "BH", and "GT1" to "GT3" constitute a sheet transport apparatus SU of Example 1.

(Description of Belt Cleaner of Example 1)

Figure 3A:
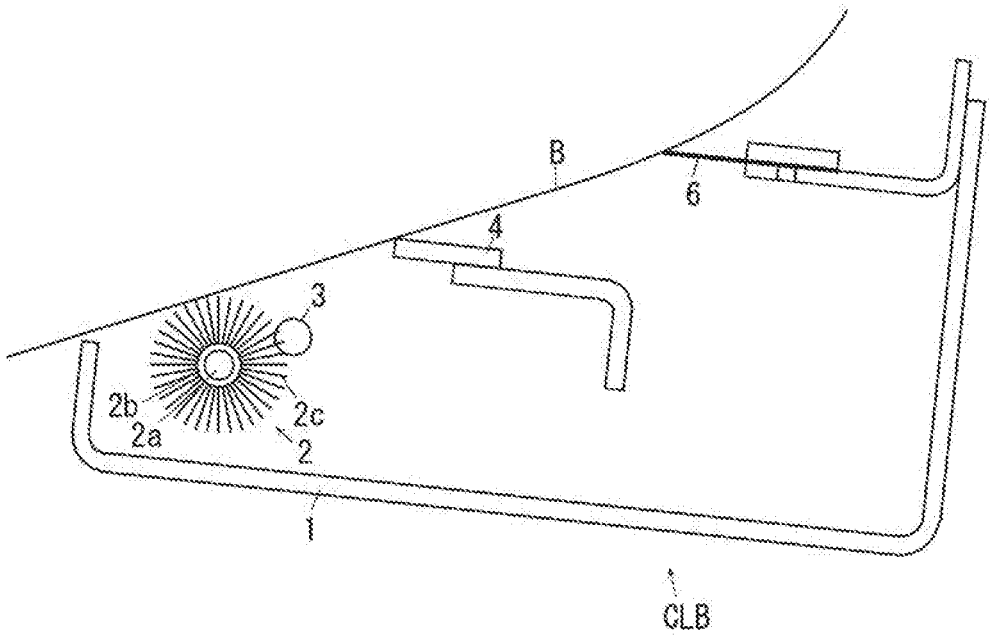
FIGS. 3A and 3B are diagrams illustrating a belt cleaner as an example of a cleaner according to Example 1.
Figure 3B:
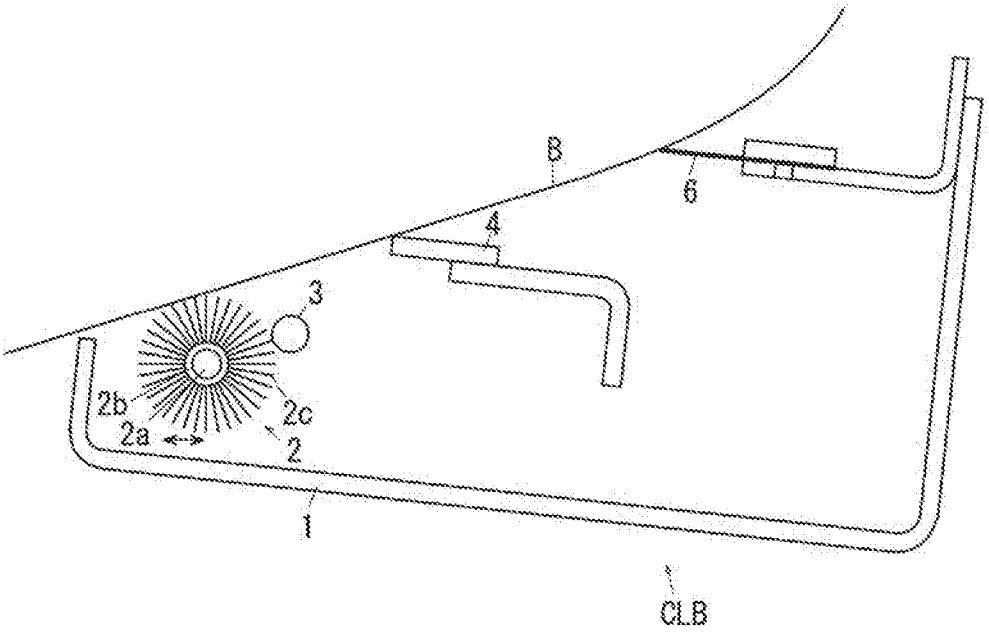

FIGS. 3A and 3B are diagrams illustrating a belt cleaner as an example of a cleaner according to Example 1. FIG. 3A is a diagram illustrating a state in which a rotary brush has moved to a reference position, and FIG. 3B is a diagram illustrating a state in which the rotary brush has moved to a pressing position.

In FIGS. 3A and 3B, the belt cleaner CLB according to Example 1 has a cleaner container 1 as an example of a housing. A rotary brush 2 as an example of a rotary cleaner is supported by the cleaner container 1 at a position upstream of the intermediate transfer belt B in the rotation direction. The rotary brush 2 of Example 1 has a rotating shaft 2*a* extending in the width direction of the intermediate transfer belt B, and a bristle 2*c* radially extending from a base 2*b* wound around the outer periphery of the rotating shaft 2*a*. The rotary brush 2 is installed such that the tip of the bristle 2*c* contacts the intermediate transfer belt B.

On the inside of the cleaner container 1, the rotary brush 2 is supported by a flicker bar 3 as an example of a deposit remover that contacts the bundle of the bristle 2*c* so as to bite and removes the deposits attached to the bristle 2*c*.

The rotary brush 2 of Example 1 is movably supported between a reference position as an example of a second position where the bristle 2*c* contacts the intermediate transfer belt B and the flicker bar 3 contacts (FIG. 3A), and a pressing position as an example of a first position where the bristle 2*c* is pressed against the intermediate transfer belt B and the contact and biting with the flicker bar 3 are weakened than at the reference position (FIG. 3B).

Inside the cleaner container 1, a cleaning blade 4 as an example of a contact cleaner is supported downstream of the rotary brush 2 in the rotation direction of the intermediate transfer belt B. The cleaning blade 4 is formed of a plate-shaped elastic body extending in the width direction of the intermediate transfer belt B. The tip of the cleaning blade 4 is installed to contact the intermediate transfer belt B.

In the cleaner container 1, a scraper 6 as an example of a third contact cleaner is supported downstream of the cleaning blade 4. The scraper 6 includes, for example, a plate-shaped metal body extending in the width direction of the intermediate transfer belt B. The tip of the scraper 6 is installed to contact the intermediate transfer belt B.

(Description of Controller of Example 1)

Figure 4:
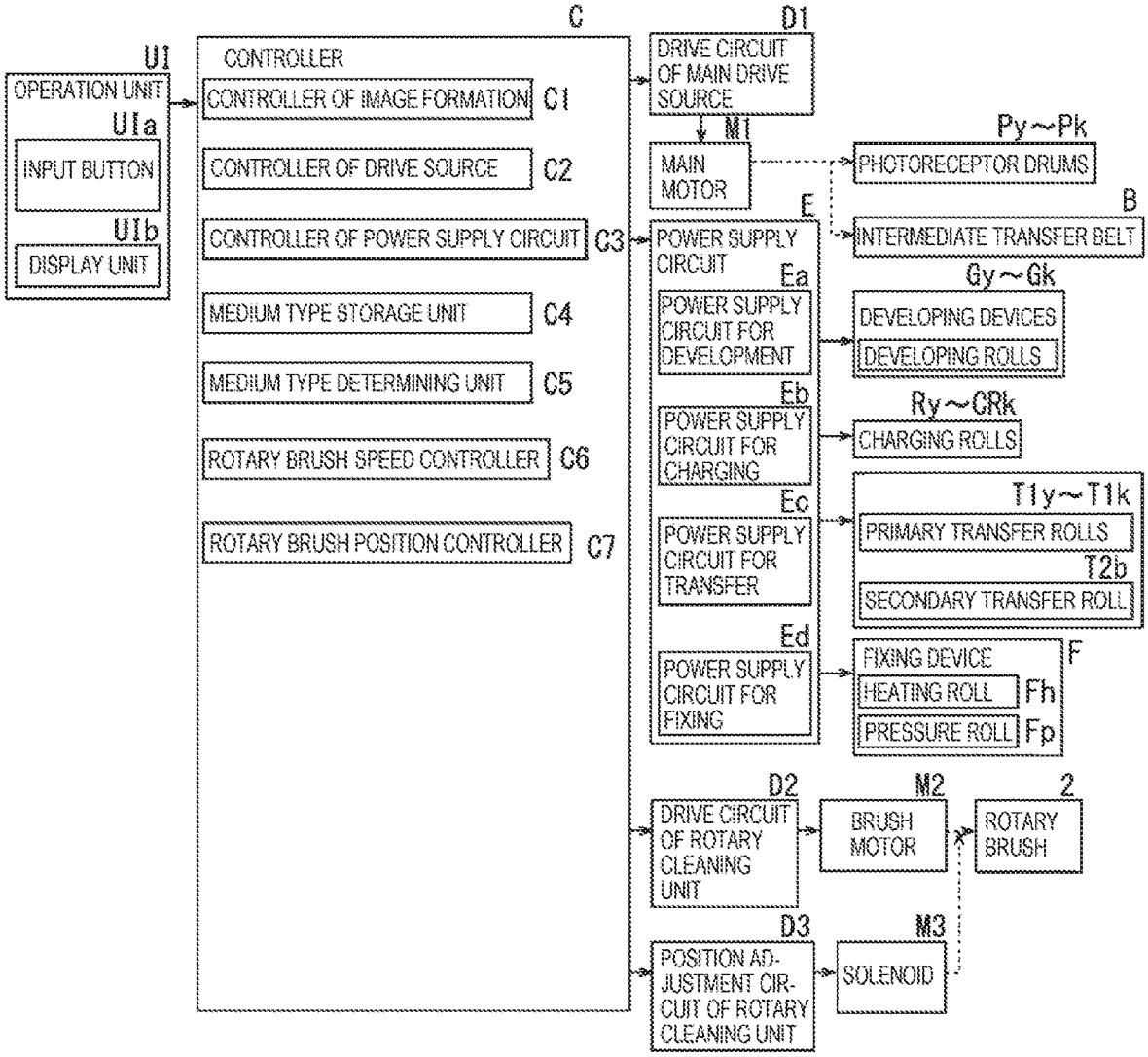
FIG. 4 is a block diagram illustrating respective functions of a controller of the image forming apparatus according to Example 1.

FIG. 4 is a block diagram illustrating respective functions of a controller of the image forming apparatus according to Example 1.

In FIG. 4, a controller C as an example of a controller of the copier U has an input/output interface I/O that performs input/output of signals with the outside. Further, the controller C has a read only memory (ROM) in which programs and information for performing necessary processes are stored. The controller C has a random access memory (RAM) for temporarily storing necessary data. Further, the controller C has a central processing unit (CPU) that performs a process according to a program stored in the ROM. Therefore, the controller C of Example 1 is constituted by a small-sized information processing device, a so-called microcomputer. Therefore, the controller C may implement various functions by executing the program stored in the ROM.

(Signal Output Element Connected to Controller C)

The controller C receives an output signal from a signal output element such as a user interface UI.

The user interface UI has an input button UIa that inputs a copy start key, a numeric keypad, and an arrow as an example of an input member.

(Controlled Elements Connected to Controller C)

The controller C is connected to a drive circuit D1 of the main drive source, a drive circuit D2 of the rotary cleaner, a position adjustment circuit D3 of the rotary cleaner, a power supply circuit E, and other control elements (not illustrated). The controller C outputs control signals to each of the circuits D1 to D3 and E.

D1: Drive Circuit of Main Drive Source

The drive circuit D1 of the main drive source rotationally drives the photoreceptor drums Py to Pk and the intermediate transfer belt B via a main motor M1 as an example of the main drive source.

E: Power Supply Circuit

The power supply circuit E includes a power supply circuit Ea for development, a power supply circuit Eb for charging, a power supply circuit Ec for transfer, and a power supply circuit Ed for fixing.

Ea: Power Supply Circuit for Development

The power supply circuit for development Ea applies a developing voltage to the developing rolls of the developing devices Gy to Gk.

Eb: Power Supply Circuit for Charging

The power supply circuit Eb for charging applies a charging voltage for charging the surfaces of the photoreceptor drums Py to Pk to each of the charging rolls CRy to CRk.

Ec: Power Supply Circuit for Transfer

The power supply circuit Ec for transfer applies a transfer voltage to the primary transfer rolls T1*y* to T1*k* and the backup roll T2*a*.

Ed: Power Supply Circuit for Fixing

The power supply circuit Ed for fixing supplies power to the heater of the heating roll Fh of the fixing device F.

D2: Drive Circuit for Rotary Cleaner

The drive circuit D2 of the rotary cleaner rotates the rotary brush 2 via a brush motor M2 as an example of a drive source.

D3: Position Adjustment Circuit of Rotary Cleaner

The position adjustment circuit D3 of the rotary cleaner moves the rotary brush 2 between a normal position and a biting position via a solenoid M3 as an example of a drive source.

(Function of Controller C)

The controller C has a function of executing a process according to an input signal from the signal output element and outputting a control signal to each of the control elements. That is, the controller C has the following functions.

C1: Controller for Image Formation

In response to an input to the user interface UI or an input of image information from an external personal computer, a controller C1 for image formation controls the driving of respective members of the scanner unit U1 and the image forming unit U3, and the timing of applying each voltage to execute a job as an image forming operation.

C2: Drive Source Controller

A drive source controller C2 controls the driving of the main motor M1 via the drive circuit D1 of the main drive source, and controls the driving of the photoreceptor drums Py to Pk. C3: Controller of power supply circuit.

A controller C3 of the power supply circuit controls each of the power supply circuits Ea to Ed to control the voltage applied to each member and the power supplied to each member.

C4: Medium Type Storage Unit

A medium type storage unit C4 stores the type of the recording sheet S as an example of a medium to be used. The medium type storage unit C4 according to Example 1 stores the type of the recording sheet S stored in each of the sheet feeding trays TR1 to TR4 of the feeder unit U2 for each of the sheet feeding trays TR1 to TR4. In Example 1, the type of the recording sheet S stored in each of the sheet feeding trays TR1 to TR4 is set and registered by the input from the user interface UI. The type of the recording sheet S may be selected and set from "thin paper", "plain paper", "thick paper", "embossed paper", "Japanese paper", and "coated paper". The type of the recording sheet S may also be set by directly inputting, for example, "sheet basis weight".

C5: Medium Type Determining Unit

A medium type determining unit C5 determines the type of the recording sheet S used for printing. The medium type determining unit C5 according to Example 1 determines the type of the recording sheet S based on information on the type of the recording sheet S of each of the sheet feeding trays TR1 to TR4 stored in the medium type storage unit C4, and the sheet feeding trays TR1 to TR4 used for printing. Further, the medium type determining unit C5 according to Example 1 determines whether the type of the recording sheet S is embossed paper or Japanese paper as an example of a medium having a high transfer sensitivity, or thin paper, plain paper, thick paper, or coated paper as an example of a medium having a low transfer sensitivity.

In the present disclosure, the phrase "transfer sensitivity" refers to the difficulty of transferring an image to the recording sheet S, and the ease of transfer when the image is turned upside down. A case where a transfer failure is likely to occur even when environments such as temperature and humidity, the fluctuation in applied voltage, and the transport speed are slightly changed is described as "having high transfer sensitivity", and conversely, a case where a transfer failure is unlikely to occur is described as "having low transfer sensitivity". Therefore, thin paper, plain paper, thick paper, and coated paper which have a smooth surface and a substantially uniform density of fiber such as pulp have low transfer sensitivity. Meanwhile, in embossed paper having irregularities on the surface, or in Japanese paper (low density medium) having unevenness in the density of pulp and containing many voids therein, the transfer sensitivity becomes higher. As will be described later with reference to FIGS. 6A and 6B, in the case of embossed paper or Japanese paper, when a transfer voltage is applied, and when the electric resistance value differs in the concave portion or void portion (the portion without fiber) and the fiber portion, or when discharge occurs in the concave portion or void, the transfer voltage fluctuates and a transfer failure easily occurs.

In the following description, embossed paper and Japanese paper may be collectively described as "high-sensitivity paper" as an example of a first medium, and plain paper and the like may be described as "low-sensitivity paper" as an example of a second medium.

In Example 1, descriptions have been made on a case where the type of the medium is determined based on the information stored in the medium type storage unit C4, but the present disclosure is not limited to this. For example, the type of the recording sheet S used for printing may be detected and determined by installing, on the sheet feeding trays TR1 to TR4 of the feeder unit U2 and the transport paths SH1 and SH2 from the sheet feeding trays TR1 to TR4 to the registration roll Rr, a sensor as an example of a detecting member that detects the type of the medium based on the thickness, light transmittivity, light reflectivity, polarization characteristics, and surface roughness of the medium. Therefore, for example, when the surface roughness of the recording sheet S detected by a sensor is higher than a predetermined value (threshold), that is, when the irregularities are large, it is possible to determine that the recording sheet S is high-sensitivity paper. Further, when the density (=weight/(thickness×area)) of the recording sheet S detected by the sensor is smaller than a predetermined value (threshold), that is, when there are many voids inside the recording sheet S, it is possible to determine that the sheet is highly sensitive.

C6: Rotary Brush Speed Controller

A rotary brush speed controller C6 as an example of a removing ability changing unit controls the rotating speed of the rotary brush 2 via a brush motor M2. When the type of the recording sheet S used in the job is high-sensitivity paper, the rotary brush speed controller C6 according to Example 1 increases the rotating speed of the rotary brush 2 at a higher speed than a case where the type of the recording sheet S is low-sensitivity paper. In an example, in the case of low-sensitivity paper, the rotary brush 2 is rotated at a rotation speed 1.17 times the peripheral speed of the intermediate transfer belt B, and the rotary brush 2 is rotated at 1.5 times the same speed for high-sensitivity paper. Specific numerical values may be appropriately changed according to changes in the configuration, design, and specifications of the copier U.

C7: Rotary Brush Position Controller

A rotary brush position controller C7 as an example of a removing ability changing unit controls the position of the rotary brush 2 via a solenoid M3. The rotary brush position controller C7 of Example 1 moves the rotary brush 2 to the biting position when the recording sheet S used in the job is high-sensitivity paper, and moves the rotary brush 2 to the normal position when the recording sheet S used in the job is low-sensitivity paper.

Operation of Example 1

In the copier U according to Example 1 having the above-described configuration, an image is transferred from the intermediate transfer belt B to the recording sheet S with the image forming operation. At this time, discharge is locally generated in the secondary transfer region Q4, and discharge products are attached to the intermediate transfer belt B. Further, the remaining developers that have not been transferred to the recording sheet S in the secondary transfer region Q4 also remain attached to the intermediate transfer belt B. Although the discharge products and the transfer residual toner are removed by the belt cleaner CLB, a part of the discharge products may not be completely removed and remains on the intermediate transfer belt B, and the discharge products increase with time. As a result, the adhesive force of the developer attached to the intermediate transfer belt B increases. When the adhesive force increases, the developer is less likely to be transferred to the recording sheet S during the secondary transfer. Therefore, a transfer failure easily occurs, and an image quality defect easily occurs.

In order to cope with an increase in discharge products over time, an image not intended for transfer of a toner band has been formed in the related art. A lubricant is externally added to the developer as an external additive. The developer is supplied to the belt cleaner CLB to improve the cleaning ability of the belt cleaner CLB, and remove the discharge products that have not been completely removed.

Figure 5A:
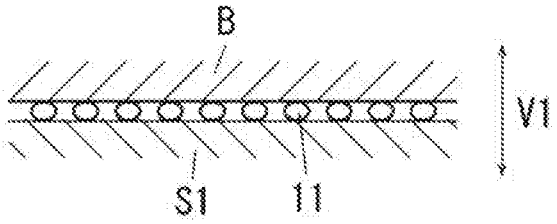
FIGS. 5A to 5C are diagrams illustrating a voltage acting in a transfer region.
Figure 5B:
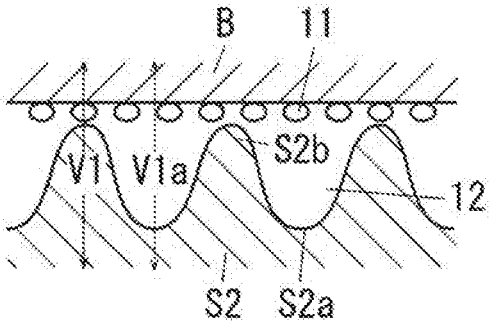
Figure 5C:
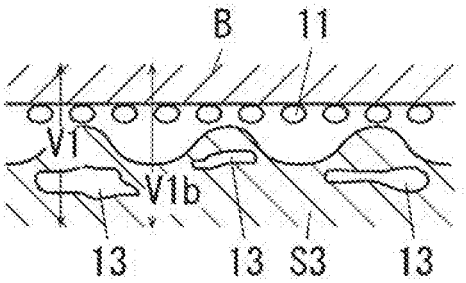

FIGS. 5A to 5C are diagrams illustrating a voltage acting in the transfer region. FIG. 5A is a diagram illustrating an example of low-sensitivity paper, FIG. 5B is a diagram illustrating an example of embossed paper, and FIG. 5C is a diagram illustrating an example of Japanese paper.

In FIGS. 5A to 5C, since low-sensitivity paper S1 such as plain paper has a smooth surface and almost no voids inside, a secondary transfer voltage V1 acts almost uniformly in the secondary transfer region Q4.

Meanwhile, as illustrated in FIG. 5B, the surface of embossed paper S2 as an example of the high-sensitivity paper has irregularities, and a gap 12 is formed between a concave portion S2*a* and the intermediate transfer belt B. Therefore, the electric resistance value in the thickness direction changes in a convex portion S2*b* having no gap 12 and the concave portion S2*a* having the gap 12. Therefore, discharge is likely to occur in the gap 12, and the acting secondary transfer voltage V1*a* may change in the concave portion S2*a*. Therefore, a transfer failure is more likely to occur in the concave portion S2*a* than in the low-sensitivity paper S1.

In FIG. 5C, in Japanese paper S3 as an example of the high-sensitivity paper, a void (gap) 13 is easily generated inside, and a transfer failure is more likely to occur in a portion having the void 13 than in a portion having no void 13 as in the case of the embossed paper S2. That is, a transfer failure is likely to occur similarly not only in the case of the Japanese paper, but also in the case of the low-density recording sheet S having a void therein.

Therefore, when the high-sensitivity paper S2 or S3 is used in a situation where the transfer failure is likely to occur due to the increase in discharge products over time, the transfer failure is more likely to occur. Thus, the high-sensitivity papers S2 and S3 are more susceptible to discharge products (higher sensitivity) than the low-sensitivity paper S1.

In Example 1, when the high-sensitivity paper S2 or S3 is used, the rotation speed of the rotary brush 2 is set higher than when the low-sensitivity paper S1 is used. Therefore, the cleaning ability of the rotary brush 2 and the ability to remove deposits are improved. Therefore, when the high-sensitivity paper is used, discharge products attached to the intermediate transfer belt B are easily removed, and the amount of discharge products on the surface of the intermediate transfer belt B is reduced. Therefore, an increase in the adhesive force of the developer to the intermediate transfer belt B is prevented. Therefore, when the high-sensitivity paper S2 or S3 is used as compared with a case where the rotary brush 2 is rotated at a constant rotation speed regardless of the sheet type, the adverse effects of the discharge products are reduced, and the transfer failure is less likely to occur.

In particular, as the rotation speed of the rotary brush 2 becomes higher, the ability to scrape off deposits such as discharge products increases. Therefore, even when deposits may not be completely removed by the rotary brush 2, when the rotary brush 2 having improved scraping ability comes into contact with the deposits, the adhesion of the deposits to the intermediate transfer belt B decreases (it becomes easier to remove the deposits). Therefore, even when the deposits may not be scraped off entirely by the rotary brush 2, the deposits may be sufficiently scraped off by the downstream cleaning blade 4.

Further, the deposits such as the developer removed by the cleaning blade 4 due to the weakening of the adhesive force by the rotary brush 2 tend to locally accumulate in a narrow gap at the tip of the cleaning blade 4. A so-called developer dam and toner dam are formed. When the developers accumulate at the tip of the cleaning blade 4, the cleaning ability of the cleaning blade 4 is improved by the effect of the external additive. Therefore, discharge products are less likely to remain on the intermediate transfer belt B, and occurrence of transfer failure is prevented.

Further, in Example 1, when high-sensitivity paper is used, the rotary brush 2 moves to the biting position. Therefore, a contact pressure between the rotary brush 2 and the intermediate transfer belt B increases, and the cleaning ability is improved as compared with at the normal position. Therefore, the amount of discharge products on the surface of the intermediate transfer belt B is further reduced, and a transfer failure is less likely to occur.

Further, in Example 1, when the rotary brush 2 moves to the biting position, the biting between the rotary brush 2 and the flicker bar 3 is weakened. The flicker bar 3 is a member that removes the deposits attached to the bristle 2*c* by causing the deposits to flip, and drops the deposits into the cleaner container 1 when the bristle 2*c* of the rotary brush 2 comes into contact with the flicker bar 3 and elastically deforms at the time of passing through the position of the flicker bar 3 and then resiliently restores to be flipped. Therefore, when the flicker bar 3 and the bristle 2*c* of the rotary brush 2 bite weakly, it is difficult to remove the deposits from the rotary brush 2. Therefore, when the deposits accumulate on the bristle 2*c* of the rotary brush 2 and the amount of the deposits increases, a phenomenon that a part of the deposits returns from the bristle 2*c* to the intermediate transfer belt B easily occurs. Here, since the deposits returned to the intermediate transfer belt B from the bristle 2*c* of the rotary brush 2 are not in a state of being rubbed against the intermediate transfer belt B, the adhesive force itself is weak. Therefore, the deposits are easily removed by the downstream cleaning blade 4. Then, in the cleaning blade 4, the above-described toner dam is formed, and the cleaning ability of the cleaning blade 4 is improved. Therefore, as compared with a case where the biting between the flicker bar 3 and the rotary brush 2 is not weakened, the discharge products of the intermediate transfer belt B are further reduced, and a transfer failure is less likely to occur.

Further, when the deposits accumulate once on the rotary brush 2, since the rotary brush 2 is gradually returned to the intermediate transfer belt B, it is possible to supply the deposits such as the developer to the cleaning blade 4 for a longer period of time as compared to a configuration of the related art in which the rotary brush 2 is not moved to the biting position. Therefore, it is possible to maintain a state where the cleaning ability of the cleaning blade 4 is high for a long period of time.

Example 2

Figure 6A:
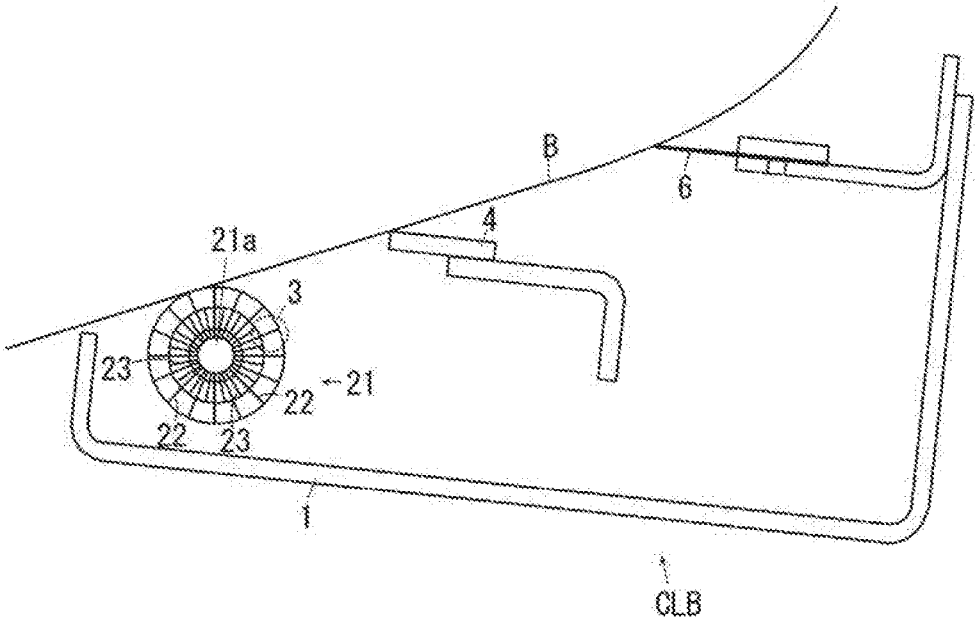
FIGS. 6A and 6B are diagrams illustrating a belt cleaner according to Example 2 corresponding to FIGS. 3A and 3B of Example 1.
Figure 6B:
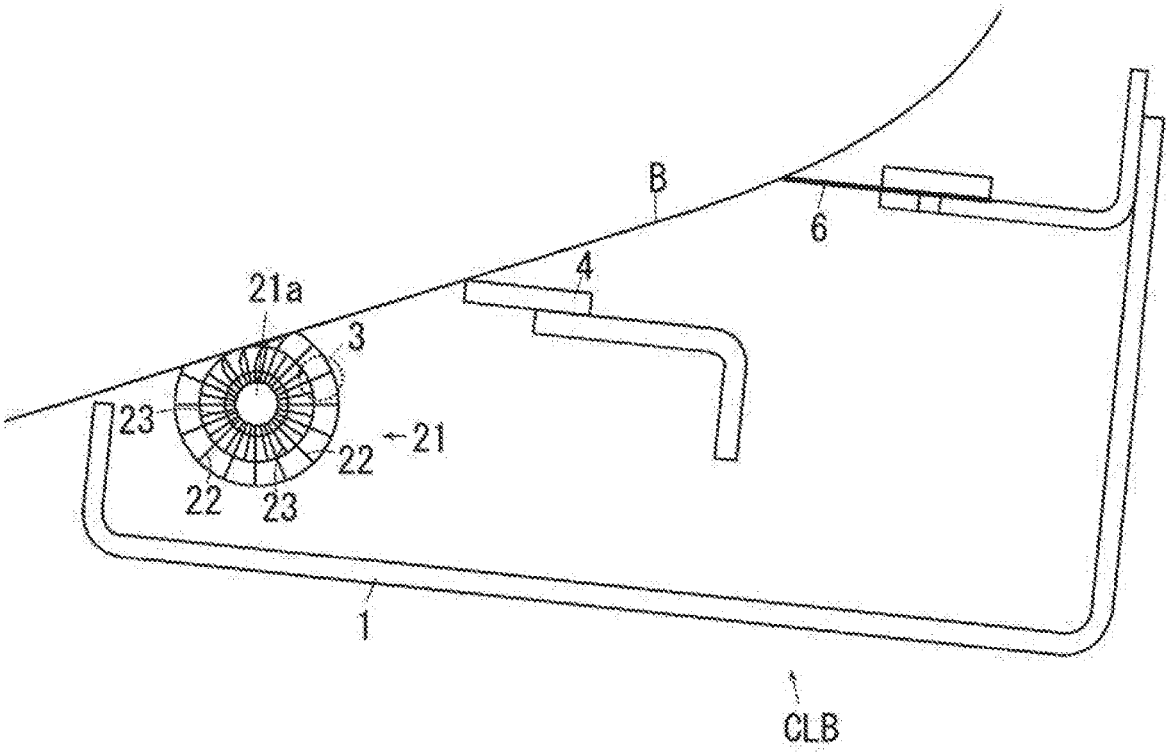

FIGS. 6A and 6B are diagrams illustrating a belt cleaner according to Example 2 corresponding to FIGS. 3A and 3B of Example 1. FIG. 6A is a diagram illustrating a normal position, and FIG. 6B is a diagram illustrating a biting position.

In the description of Example 2, components corresponding to the components of Example 1 are denoted by the same reference numerals, and detailed descriptions thereof will be omitted.

Example 2 is different from Example 1 in the following points, but has the same configuration as Example 1 in other points.

In FIGS. 6A and 6B, the belt cleaner CLB of Example 2 has a rotary brush 21 as an example of a brush-like cleaner, instead of the rotary brush 2 of Example 1. The rotary brush 21 according to Example 2 has long bristles 22 and short bristles 23. Then, similarly to Example 1, the rotary brush 21 may move between the biting position approaching the intermediate transfer belt B (see FIG. 6B) and a normal position separated from the biting position (see FIG. 6A). At the normal position, the rotary brush 21 moves so that the long bristles 22 come into contact with the intermediate transfer belt B and the short bristles 23 do not come into contact with the intermediate transfer belt B. Further, at the biting position, the rotary brush 21 moves so that both the long bristles 22 and the short bristles 23 come into contact with the intermediate transfer belt B. Therefore, at the biting position where both the long bristles 22 and the short bristles 23 are in contact, the density of the bristles used for cleaning is higher than at the normal position where only the long bristles 22 are in contact.

In Example 2, unlike Example 1 in which the flicker bar 3 is fixed, the flicker bar 3 also moves integrally with the rotary brush 21. In Example 2, as in Example 1, it may be configured such that the flicker bar 3 is fixed and only the rotary brush 21 moves.

Further, although not illustrated, in the controller C, the rotary brush position controller C7 of Example 2 moves the rotary brush 21 to the biting position when high-sensitivity paper is used, and moves the rotary brush 21 to the normal position when low-sensitivity paper is used.

Operation of Example 2

In the copier U according to Example 2 having the above-described configuration, when high-sensitivity paper is used, the rotary brush 21 is moved to the biting position. Therefore, the intermediate transfer belt B is cleaned by the high-density bristles 22 and 23. That is, the cleaning ability and the deposit removing ability are improved as compared with the case of low-sensitivity paper. Therefore, as in Example 1, the deposits on the surface of the intermediate transfer belt B are easily removed, and the occurrence of transfer failure is reduced.

Example 3

Figure 7A:
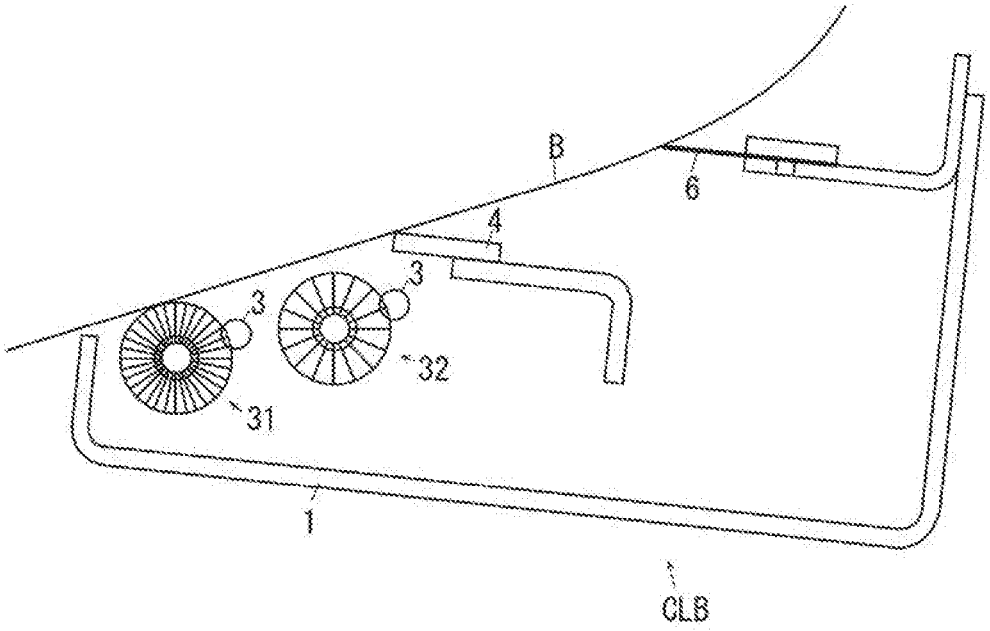
FIGS. 7A and 7B are diagrams illustrating a belt cleaner according to Example 3 corresponding to FIGS. 3A and 3B of Example 1.
Figure 7B:
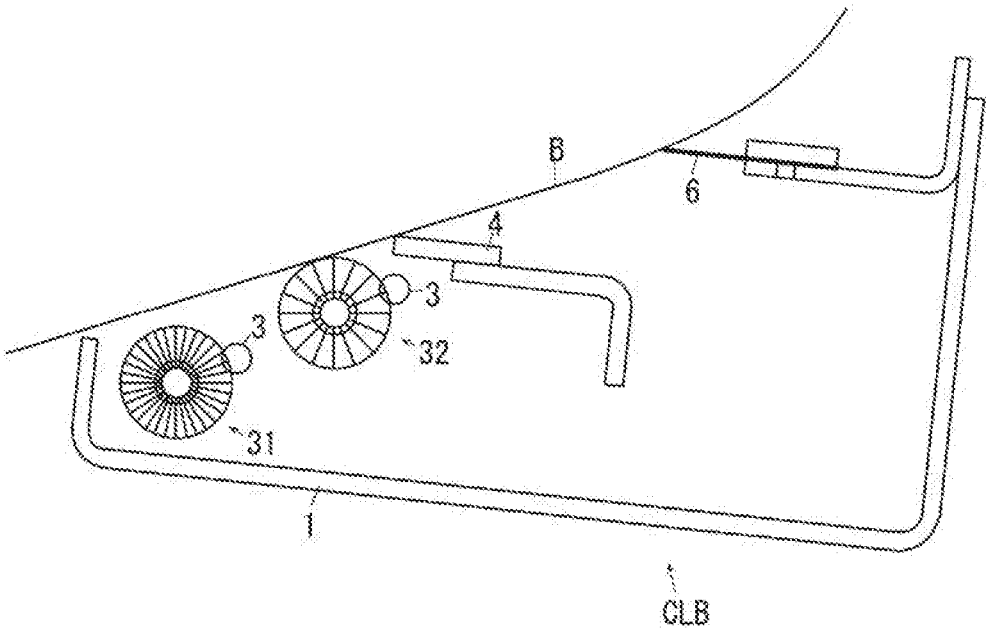

FIGS. 7A and 7B are diagrams illustrating a belt cleaner according to Example 3 corresponding to FIGS. 3A and 3B of Example 1. FIG. 7A is a diagram illustrating a case where high sensitivity paper is used, and FIG. 7B is a diagram illustrating a case where low-sensitivity paper is used.

In the description of Example 3, components corresponding to the components of Example 1 are denoted by the same reference numerals, and detailed descriptions thereof will be omitted.

Example 3 is different from Example 1 in the following points but has the same configuration as Example 1 in other points.

In FIGS. 7A and 7B, in the belt cleaner CLB of Example 3, a high-density rotary brush 31 as an example of a first brush-like cleaner and a low-density rotary brush 32 as an example of a second brush-like cleaner are arranged instead of the rotary brush 2 of Example 1. The brushes 31 and 32 constitute the brush-like cleaner of Example 3.

The high-density rotary brush 31 and the low-density rotary brush 32 have the same configuration except that the density of the two brushes is different. A drive source such as a solenoid (not illustrated) is provided for each of the rotary brushes 31 and 32, and each of the brushes 31 and 32 is configured to be able to independently contact and be separated from the intermediate transfer belt B. Although not illustrated, when high-sensitivity paper is used, the rotary brush position controller C7 of the controller of Example 3 brings the high-density rotary brush 31 into contact with the intermediate transfer belt B and separates the low-density rotary brush 32 from the intermediate transfer belt B, as illustrated in FIG. 7A. Further, when low-sensitivity paper is used, the high-density rotary brush 31 is separated from the intermediate transfer belt B, and the low-density rotary brush 32 is brought into contact with the intermediate transfer belt B, as illustrated in FIG. 7B.

Operation of Example 3

In the copier U according to Example 3 having the above-described configuration, when high-sensitivity paper is used, the high-density rotary brush 31 contacts the intermediate transfer belt B, and when low-sensitivity paper is used, the low-density rotary brush 32 contacts the intermediate transfer belt B. Therefore, when high-sensitivity paper is used, the ability of the belt cleaner CLB to remove deposits on the intermediate transfer belt B is improved. Therefore, similarly to Examples 1 and 2, when high-sensitivity paper is used, the discharge products of the intermediate transfer belt B are reduced, and the increase in the adhesive force of the developer to the intermediate transfer belt B is prevented. Thus, the transfer failure is prevented.

Example 4

Figure 8A:
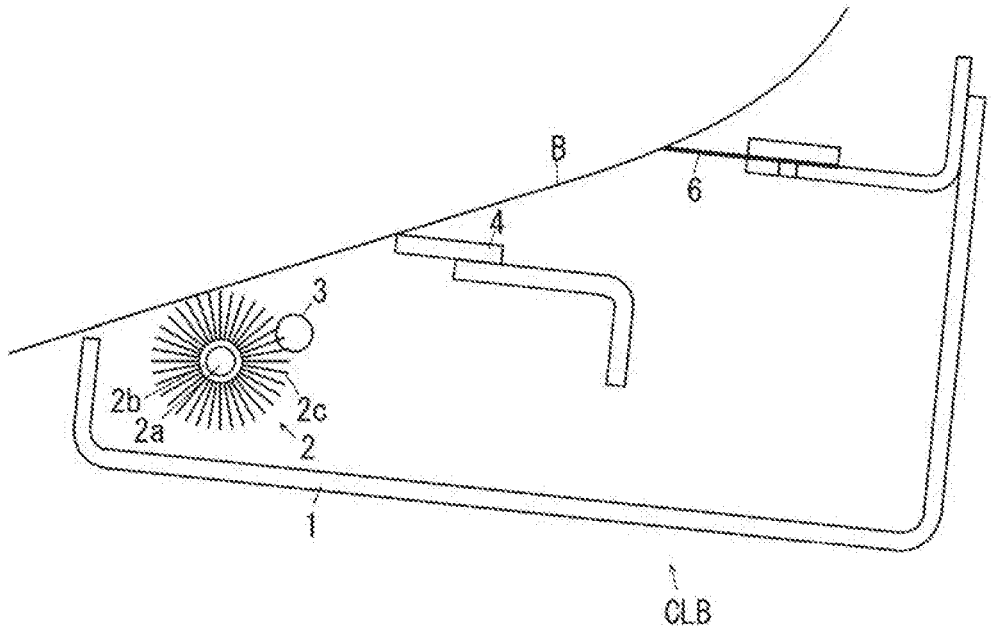
FIGS. 8A and 8B are diagrams illustrating a belt cleaner according to Example 4, and correspond to FIGS. 3A and 3B of Example 1.
Figure 8B:
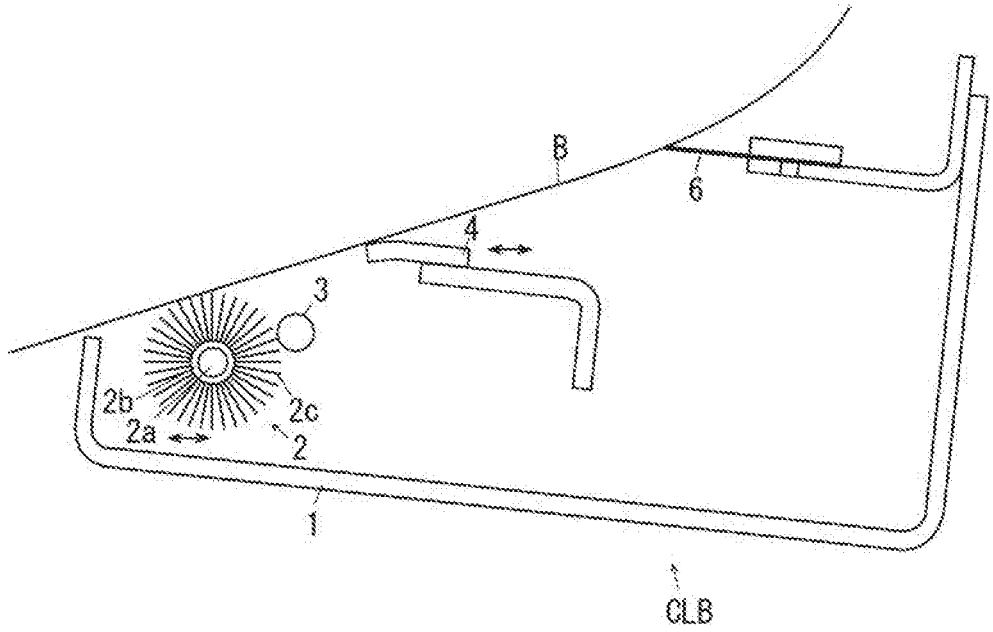

FIGS. 8A and 8B are diagrams illustrating a belt cleaner according to Example 4 and correspond to FIGS. 3A and 3B of Example 1.

In the description of Example 4, components corresponding to the components of Example 1 are denoted by the same reference numerals, and detailed descriptions thereof will be omitted.

Example 4 is different from Example 1 in the following points but has the same configuration as Example 1 in other points.

In FIGS. 8A and 8B, in the belt cleaner CLB of Example 4, unlike Example 1, the cleaning blade 4 as an example of the second contact cleaner is configured to be movable between the blade biting position and the blade normal position, similarly to the biting position and the normal position of the rotary brush 2 as an example of the first contact cleaner.

(Description of Controller of Example 4)

Figure 9:
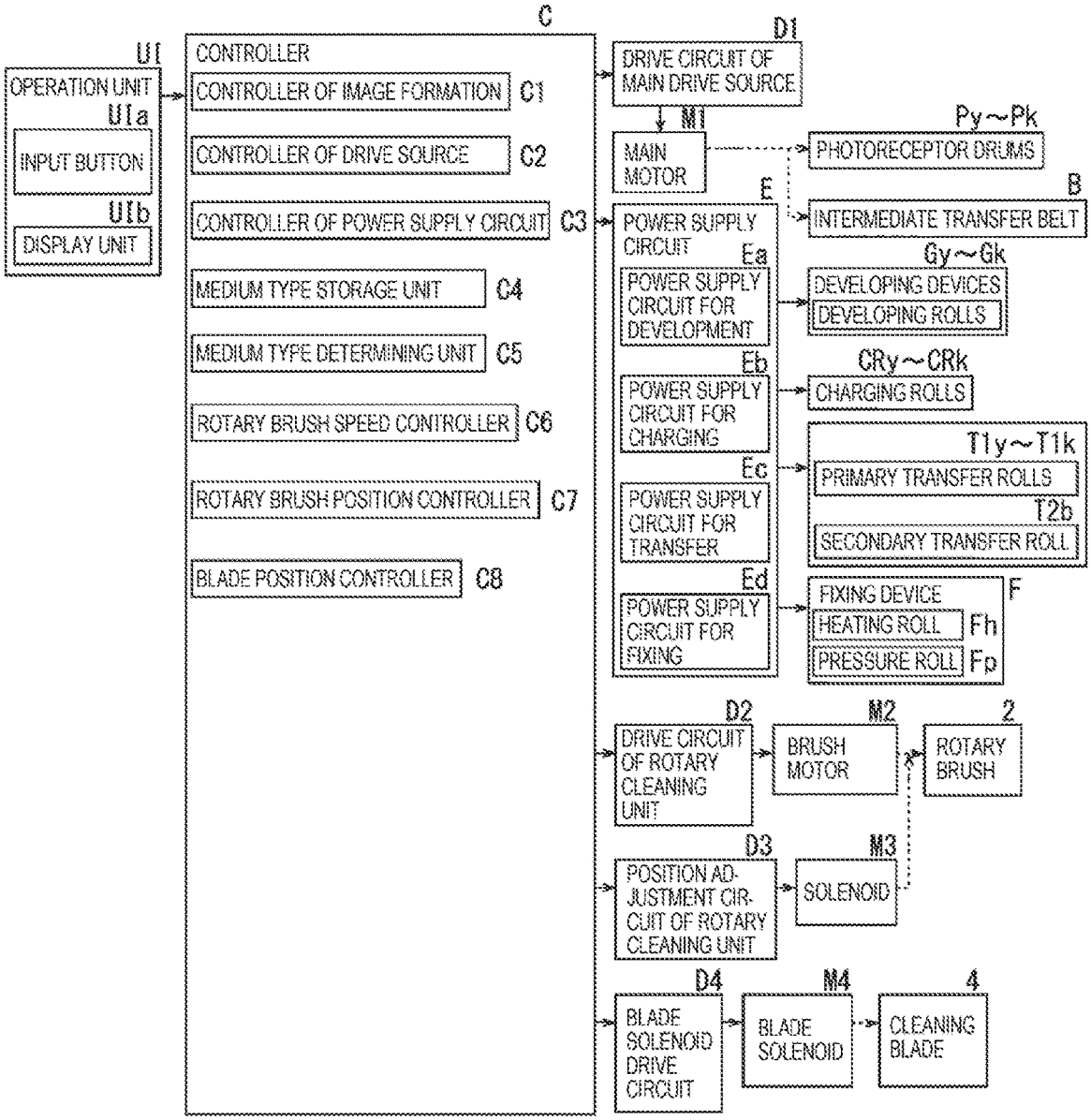
FIG. 9 is a block diagram illustrating respective functions of a controller of the image forming apparatus according to Example 4 and corresponds to FIG. 4 of Example 1.

FIG. 9 is a block diagram illustrating respective functions of a controller of the image forming apparatus according to Example 4 and corresponds to FIG. 4 of Example 1.

In FIG. 9, the controller C of Example 4 has a blade position controller C8 as an example of a removing ability changing unit in addition to the units C1 to C7 of Example 1. The blade position controller C8 controls a blade solenoid M4 via a blade solenoid drive circuit D4 and moves the position of the cleaning blade 4 between the blade biting position and the blade normal position. The blade position controller C8 of Example 4 moves the cleaning blade 4 to the blade cutting position when high sensitivity is used, and moves the cleaning blade 4 to the blade normal position when low sensitivity paper is used.

Operation of Example 4

In the copier U according to Example 4 having the above-described configuration, when high-sensitivity paper is used, the rotary brush 2 moves to the biting position, and moves to the blade biting position of the cleaning blade 4. Therefore, since the contact pressure between the rotary brush 2 and the intermediate transfer belt B increases, the cleaning ability of the rotary brush 2 improves, and the contact pressure between the cleaning blade 4 and the intermediate transfer belt B also increases. Thus, the cleaning ability of the cleaning blade 4 is also improved. Therefore, as in the case of Examples 1 to 3, the amount of deposits on the surface of the intermediate transfer belt B is reduced, and the transfer failure is prevented.

(Modifications)

As described above, Examples of the present disclosure have been described in detail. However, the present disclosure is not limited to the above-described Examples, and various changes may be made within the scope of the present disclosure. Modifications (H01) to (H09) of the present disclosure are exemplified below.

(H01) In the above-described Examples, the copier U has been described as an example of the image forming apparatus, but the present disclosure is not limited to this. The present disclosure is applicable to a facsimile machine and a multifunction device having plural functions, such as a facsimile machine, a printer, or a copier. Further, the image forming apparatus is not limited to a multi-color developing image forming apparatus, but may be a single-color, so-called monochrome image forming apparatus. Therefore, the intermediate transfer belt B and the belt cleaner CLB have been described as examples of the image carrier, but the present disclosure is also applicable to the photoreceptor drums Py to Pk and the drum cleaners CLy to CLk as examples of the image carrier.

(H02) In the above-described Examples, the specific numerical values exemplified may be changed as appropriate in accordance with changes in design and specifications.

(H03) In the above-described Examples, Examples 1 to 4 may be combined with each other. For example, the belt cleaner CLB may also be configured to have both the rotary brush 21 of Example 2 and the cleaning blade 4 of Example 4.

(H04) In Example 2, the rotary brush 21 is not limited to the configuration having both the long bristles 22 and the short bristles 23. For example, it is possible to adopt a configuration in which a base having long bristles 22 is spirally wound with respect to the axial direction of a rotating shaft 21*a* of the rotary brush 21 and a base having short bristles 23 is spirally wound on the rotating shaft 21*a*, that is, a rotary brush having a so-called double spiral structure.

(H05) In Examples 2 to 4, it is desirable to set the rotation speed of the rotary brushes 2, 21, and 31 to a high speed in the case of high-sensitivity paper, but the present disclosure is not limited to this. The rotation speed of the high-sensitivity paper may be the same as that of the low-sensitivity paper. In Examples 2 to 4, it is also possible to adopt a configuration in which the rotary brush does not rotate, for example, a brush-like configuration raised from a base having a flat plate shape. Further, in Example 4, a blade-shaped cleaner may be used instead of the rotary brush.

(H06) In Example 4, the rotary brush 2 may be moved toward and away from the intermediate transfer belt B, but the present disclosure is not limited to this. In the case of high-sensitivity paper, it is possible to adopt a configuration in which the position of the rotary brush 2 does not move only by increasing the contact pressure of the cleaning blade 4.

(H07) In Example 1, the configuration in which the rotary brush 2 is moved toward and away from the intermediate transfer belt B has been described. However, it is also possible to adopt a configuration in which the rotation speed of the rotary brush 2 is increased with high-sensitivity paper and the position of the rotary brush 2 does not move.

(H08) In Example 1, in the case of high-sensitivity paper, it is desirable to weaken the biting between the flicker bar 3 and the rotary brush 2, but the present disclosure is not limited to this. Even in the case of high-sensitivity paper, it is possible to adopt a configuration in which the biting does not change as compared to the case of low-sensitivity paper.

(H09) In Example 3, a configuration in which the two rotary brushes 31 and 32 are operated independently has been described, but the present disclosure is not limited to this. It is also possible to adopt a configuration in which the two components are linked to each other so that one is in contact when the other is separated, for example, a configuration like a seesaw. In addition, it is also possible to adopt a configuration in which the low-density rotary brush 32 is always in contact with the intermediate transfer belt B, and also contacts the high-density rotary brush 31 in the case of high-sensitivity paper, that is, a configuration in which cleaning is performed with one rotary brush on low-sensitivity paper and cleaning is performed with two rotary brushes on high-sensitivity paper.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming apparatus comprising:

an image carrier configured to carry an image;

a transfer unit configured to transfer the image to a medium; and a cleaner configured to remove deposits on a surface of the image carrier after passing through a position of the transfer unit, wherein when a type of a medium to be used is a first medium, the cleaner improves an ability to remove the deposits from the image carrier by changing operating characteristics of the cleaner, as compared with a case where the medium to be used is a second medium having a lower transfer sensitivity than the first medium, wherein the first medium is a medium having a lower density than the second medium.

2. The image forming apparatus according to claim 1, wherein the first medium has a higher surface roughness than the second medium.

3. The image forming apparatus according to claim 1, further comprising:

a determining unit configured to determine the type of the medium.

4. The image forming apparatus according to claim 1, wherein the cleaner comprises a rotary cleaner configured to rotate and clean the image carrier while contacting the image carrier, and a contact cleaner that is disposed downstream of the rotary cleaner in a rotation direction of the image carrier, the contact cleaner being configured to clean the image carrier while contacting the image carrier, and when the medium to be used is the first medium, a rotation speed of the rotary cleaner is increased as compared with the case where the medium to be used is the second medium having the lower transfer sensitivity, so as to improve an ability to remove discharge products.

5. The image forming apparatus according to claim 4, wherein the cleaner further comprises a deposit remover unit configured to remove deposits attached to the rotary cleaner while contacting the rotary cleaner, and when the medium to be used is the first medium, a contact of the deposit remover with the rotary cleaner is caused to become weaker as compared with the case where the medium to be used is the second medium.

6. The image forming apparatus according to claim 1, wherein the cleaner comprises a brush-like cleaner that includes a plurality of bristles, the brush-like cleaner configured to clean the image carrier while contacting the image carrier, and a contact cleaner that is disposed downstream of the brush-like cleaner in a rotation direction of the image carrier, the contact cleaner being configured to clean the image carrier while contacting the image carrier, and when the medium to be used is the first medium, density of the plurality of bristles is increased to improve an ability to remove discharge products as compared with the case where the medium to be used is the second medium.

7. The image forming apparatus according to claim 6, wherein the brush-like cleaner has long bristles and short bristles, when the medium to be used is the second medium, only the long bristles are brought into contact with the image carrier, and when the medium to be used is the first medium, the brush-like cleaner is moved toward to the image carrier and the long bristles and the short bristles are brought into contact with the image carrier so as to increase the density of the bristles.

8. The image forming apparatus according to claim 6, wherein the brush-like cleaner comprises a first brush-like cleaner having bristles, and a second brush-like cleaner having bristles that are lower in density than the first brush-like cleaner, when the medium to be used is the first medium, the first brush-like cleaner is brought into contact with the image carrier, and when the medium to be used is the second medium, the second brush-like cleaner is brought into contact with the image carrier.

9. The image forming apparatus according to claim 1, wherein the cleaner comprises a contact cleaner configured to clean the image carrier while contacting the image carrier, and when the medium to be used is the first medium, a contact pressure of the contact cleaner to the image carrier is increased as compared with the case where the medium to be used is the second medium, so as to improve an ability to remove discharge products.

10. The image forming apparatus according to claim 2, wherein the cleaner comprises a contact cleaner configured to clean the image carrier while contacting the image carrier, and when the medium to be used is the first medium, a contact pressure of the contact cleaner to the image carrier is increased as compared with the case where the medium to be used is the second medium, so as to improve an ability to remove discharge products.

11. The image forming apparatus according to claim 9, wherein the contact cleaner comprises a first contact cleaner configured to clean the image carrier while contacting the image carrier, and a second contact cleaner that is disposed downstream of the first contact cleaner in a rotation direction of the image carrier, the second contact cleaner being configured to clean the image carrier while contacting the image carrier, and when the medium to be used is the first medium, a contact pressure of the second contact cleaner to the image carrier is increased as compared with the case where the medium to be used is the second medium.

12. The image forming apparatus according to claim 10, wherein the contact cleaner comprises a first contact cleaner configured to clean the image carrier while contacting the image carrier, and a second contact cleaner that is disposed downstream of the first contact cleaner in a rotation direction of the image carrier, the second contact cleaner being configured to clean the image carrier while contacting the image carrier, and when the medium to be used is the first medium, a contact pressure of the second contact cleaner to the image carrier is increased as compared with the case where the medium to be used is the second medium.

13. The image forming apparatus according to claim 9, wherein the contact cleaner comprises a first contact cleaner configured to clean the image carrier while contacting the image carrier, and a second contact cleaner that is disposed downstream of the first contact cleaner in a rotation direction of the image carrier, the second contact cleaner being configured to clean the image carrier while contacting the image carrier, and when the medium to be used is the first medium, a contact pressure of the first contact cleaner to the image carrier is increased as compared with the case where the medium to be used is the second medium.

14. The image forming apparatus according to claim 10, wherein the contact cleaner comprises a first contact cleaner configured to clean the image carrier while contacting the image carrier, and a second contact cleaner that is disposed downstream of the first contact cleaner in a rotation direction of the image carrier, the second contact cleaner being configured to clean the image carrier while contacting the image carrier, and when the medium to be used is the first medium, a contact pressure of the first contact cleaner to the image carrier is increased as compared with the case where the medium to be used is the second medium.

15. An image forming apparatus comprising:

image carrying means for carrying an image;

transfer means for transferring the image to a medium; and cleaning means for removing deposits on a surface of the image carrying means after passing through a position of the transfer means, wherein when a type of a medium to be used is a first medium, the operation of the cleaning is changed to remove the deposits from the image carrying means as compared with a case where the medium to be used is a second medium having a lower transfer sensitivity than the first medium, wherein the first medium is a medium having a lower density than the second medium.

* * * * *